United States Patent [19]

Aho

[11] 4,130,198

[45] Dec. 19, 1978

[54] MULTI-PART LIQUID CONTAINER

[75] Inventor: Kenneth A. Aho, Roseville, Minn.

[73] Assignee: Minnesota Mining and Manufacturing Company, Saint Paul, Minn.

[21] Appl. No.: 890,472

[22] Filed: Mar. 27, 1978

[51] Int. Cl.[2] ..... B65D 25/08

[52] U.S. Cl. ..... 206/221; 220/229

[58] Field of Search ..... 220/229; 206/219, 221, 206/15.2

[56] References Cited

U.S. PATENT DOCUMENTS

| | | | |
|---|---|---|---|
| 2,213,465 | 9/1940 | Gay | 220/229 |
| 2,719,628 | 10/1955 | Ivanoff | 206/221 |
| 2,819,738 | 1/1958 | Marberg | 206/219 |
| 3,043,424 | 7/1962 | Howard | 206/219 |
| 3,088,586 | 5/1963 | Hardman | 206/221 |
| 3,149,943 | 9/1964 | Amador | 206/221 |
| 3,797,646 | 3/1974 | Horne | 206/219 |

FOREIGN PATENT DOCUMENTS

| | | | |
|---|---|---|---|
| 227224 | 8/1958 | Australia | 206/221 |

*Primary Examiner*—William Price
*Assistant Examiner*—Bruce H. Bernstein
*Attorney, Agent, or Firm*—Cruzan Alexander; Donald M. Sell; Terryl K. Qualey

[57] ABSTRACT

A container for two fluids to be mixed just prior to use in which a rigid, fluid-tight, primary container contains the first fluid and has a cover formed with two spaced parallel slots. An elongate, flexible, plastic bag contains the second fluid within the primary container and has its ends extending out of the slots in the cover of the primary container, and a squeegee is mounted in one of the slots to squeeze the fluid from the plastic bag as it is pulled therethrough. A strip of tape covers the projecting ends of the bag and is removably adhered to the cover therearound to seal the container and retain the ends of the plastic bag during shipment and storage to maintain the fluids separate until they are to be mixed for use.

10 Claims, 4 Drawing Figures

MULTI-PART LIQUID CONTAINER

FIELD OF THE INVENTION

The present invention relates to a container for two or more fluids which are to be kept separate during shipment and storage but which are to be mixed just prior to use.

BACKGROUND OF THE INVENTION

Many chemical systems consist of two or more fluids which are mixed just prior to use and which, when mixed, react. Such chemical systems are used, for example, to provide a fluid which, when two components are mixed, can be poured and which in a short time polymerizes to produce a solid. These systems are extensively used in encapsulating splices in power and telephone cables to exclude water.

In the prior art, multi-part fluid systems have frequently been provided in separate containers with space being left in one of the containers for the contents of the other containers, as disclosed in U.S. Pat. No. 2,819,783. Alternatively the smaller containers have been floated on or suspended in the liquid in the larger containers, such as disclosed in U.S. Pat. Nos. 3,052,371; 3,261,457; 3,567,463 and 3,797,646.

In some cases, particularly where the ratio of the components is greatly disproportionate, the ratio of the components is very critical and it is important that the contents of the containers not only contain the correct proportions but also that all of the materials be mixed together. In the prior art it has been left to the user to empty all the contents of one container into the other container to obtain the proper proportions.

SUMMARY OF THE INVENTION

The present invention provides a container for at least two fluids to be mixed just prior to use and includes a rigid, fluid-tight, primary container having a cover and containing a first fluid, the cover being formed with two spaced parallel slots. A squeegee comprising a pair of parallel, closely spaced members is fixedly positioned in the first of the slots in the cover parallel to the slots and projecting into the container. An elongate, flexible, bag containing a second fluid passes through the squeegee into the primary container and out of the second slot in the cover so that one end of the bag projects from the primary container through the squeegee and the other end of the bag projects from the primary container through the second slot. A strip of tape covers the projecting ends of the bag and is removably adhered to the cover around the bag ends.

In use, the tape is removed from the cover and the end of the bag projecting from the primary container through the second slot slips through the second slot into the primary container. The end of the bag projecting from the primary container through the squeegee is then pulled on to pull the remainder of the bag through the squeegee, the contents of the bag being substantially completely removed by the squeegee as the bag is pulled therethrough.

THE DRAWING

Figure 1:
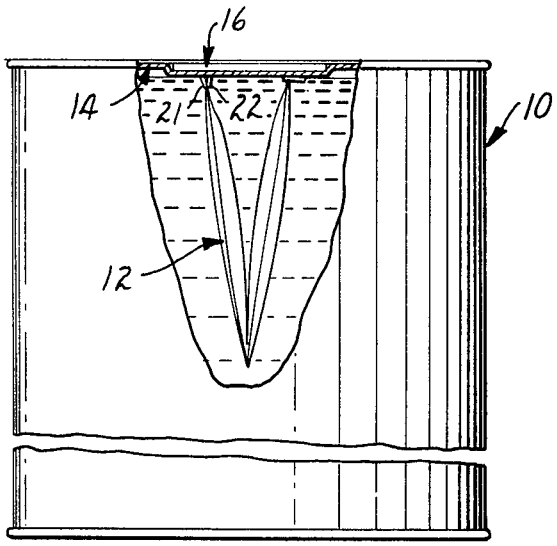
FIG. 1 is an elevation view of a container constructed in accordance with the present invention with a portion of the outer, primary container broken away.

The container of the present invention comprises a rigid, fluid-tight, primary container 10 containing a first fluid and an elongate flexible plastic bag 12 containing a second fluid.

The primary container 10 has a cover 14. In the illustrated embodiment the primary container 10 is a one gallon tin can with a removable sealing cover much like an ordinary one gallon paint can. The cover 14 includes a molded plastic insert 16 secured centrally to the metal portion of the cover. The plastic insert 16 is formed with two spaced parallel slots 18 and 19 which also extend through the metal portion of the cover 14. In the first slot 18 the insert 16 is formed with a pair of parallel, opposed converging blades 21 and 22 directed into the primary container 10 to define a squeegee. In the second slot 19, the insert 16 is formed with walls 24 extending into the primary container 10 perpendicular to the generally planar upper surface of the cover 14.

The bag 12 is generally tubular with one closed end 26 and one open end 27. For ease of manufacture, it is preferable that the bag 12 be made of a heat sealable material, for example, a polyethylene, polyester film laminate such as disclosed in U.S. Pat. Nos. 3,188,265 and 3,188,266. The closed end 26 of the bag 12 extends out of the primary container 10 through the squeegee formed by the blades 21 and 22. The open end 27 of the bag 12 extends out of the second slot 19, is doubled back upon itself and extends back into the primary container 10 so that the very end of the bag and the opening therein are positioned inside the primary container 10. If more than two fluids are necessary, the bag 12 may be sealed to form two or more separated longitudinal compartments for the multiple fluids. Alternatively multiple bags may be mounted together like the single bag 12 in the illustrated embodiment. It is also contemplated within the present invention that the fluid in the bag 12 may be a free flowing powder, such as a catalyst for the first fluid in the primary container 10.

A removable plastic seal 29 is formed with a generally planar portion 30 covering the second slot 19 and a projection 31 from one face of the planar portion 30 fitting into the second slot 19 and with the closed end 26 of the bag 12 filling the second slot 19 to seal it and mechanically hold the closed end 26 to the bag 12. The planar portion 30 is made thinner adjacent the projection 31 to define a hinge 32 across the width of the planar portion 30 about which relative pivoting movement can occur of the portions on either side of the hinge 32 as will be more fully described hereinafter. Both ends 26 and 27 of the bag 12 extend between the plastic insert 16 of the cover 14 and the planar portion 30 of the plastic seal 29 to properly position and mechanically hold the ends of the bag during shipment and storage.

A strip of tape 34 having pressure sensitive adhesive on one surface completely covers the ends 26 and 27 of the bag 12 and the plastic insert 16 and is adhered to the metal portion of the cover 14 therearound. It is also adhered to the exposed portions of the plastic insert 16, the closed end 26 of the bag 14 and the plastic seal 29.

Along the edge of the tape 34 parallel to the slots 18 and 19 and to the side of the second slot 19 away from the first slot 18, the tape 34 is formed with a non-adhesive tab 35 which may be grasped for removal of the tape 34 from the cover 14.

Figure 2:
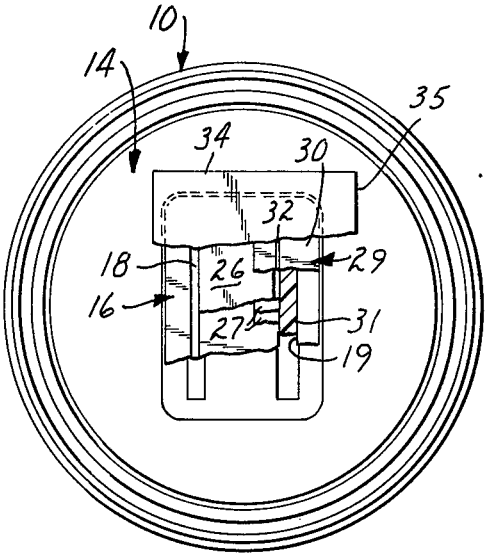
FIG. 2 is a plan view of the container of FIG. 1 showing the cover with portions removed for clarity.
Figure 3:
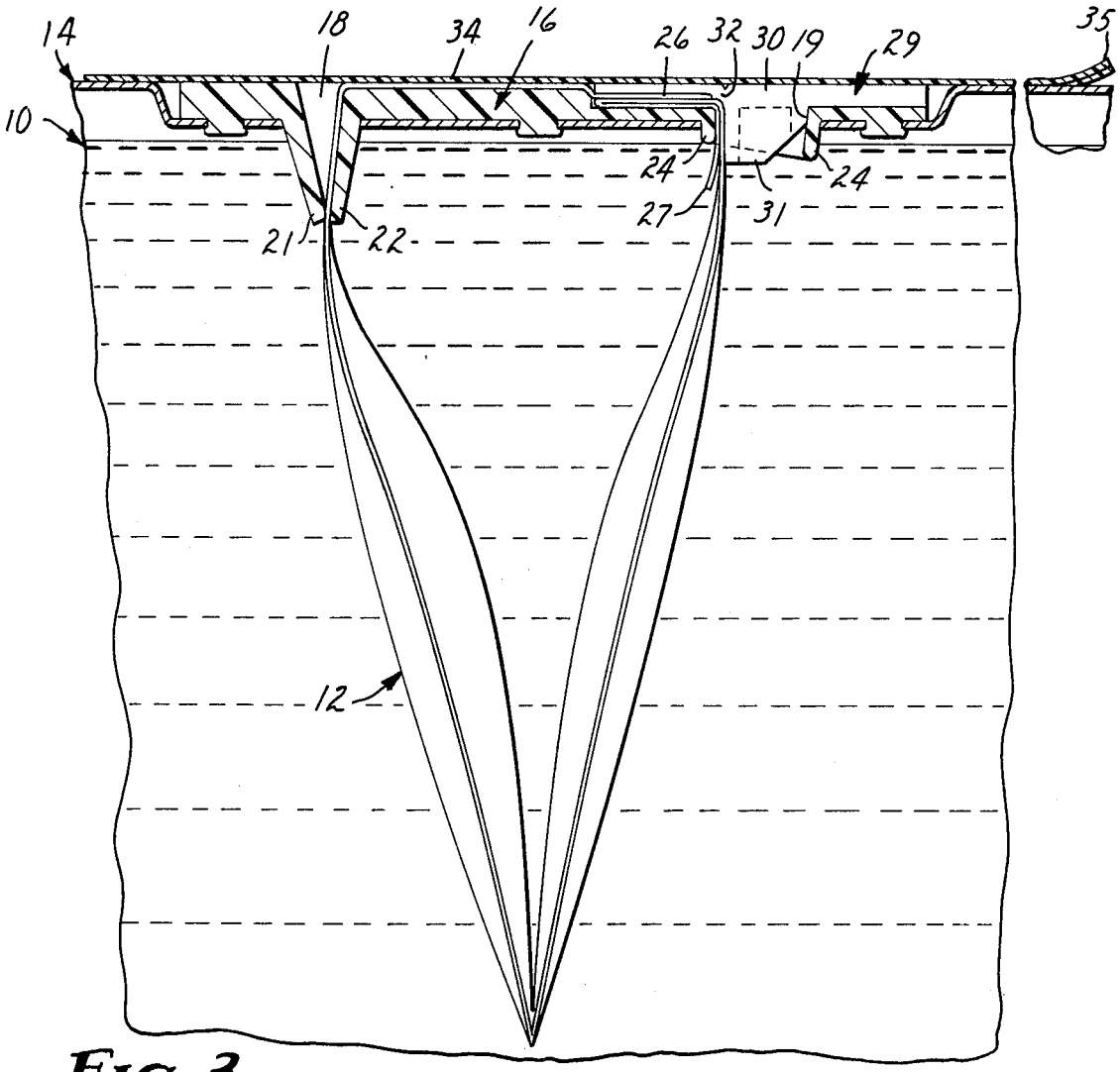
FIG. 3 is an elevational cross sectional view of the container of FIG. 1 with the parts in their positions for storage and shipment.
Figure 4:
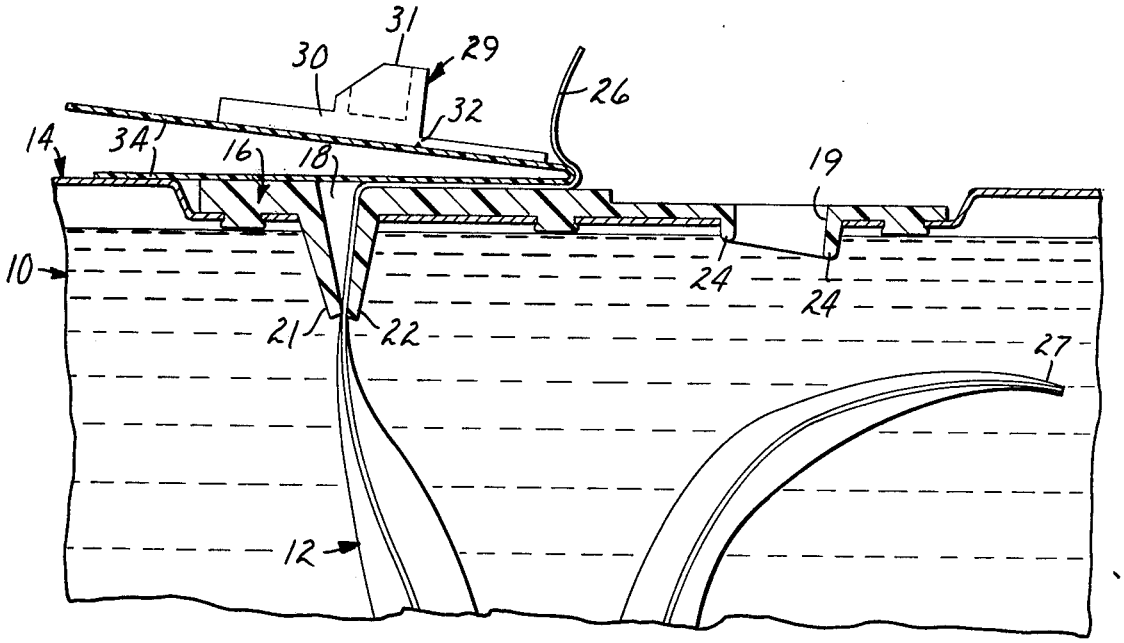
FIG. 4 is a view similar to FIG. 3 illustrating an intermediate position in the opening of the container to mix the two fluids.

The container of the present invention is assembled as illustrated in FIGS. 1-3 for shipment and storage with a first fluid in the primary container 10 and a second fluid in the plastic bag 12 so as to keep the fluids separate but in a single container. When it is desired to mix the two fluids and use the resulting composition, the non-adhesive tab 35 on the adhesive tape 34 is grasped and pulled upward away from the cover 14 from right to left in FIG. 3. As the adhesive tape 34 is lifted, the plastic seal 29 adheres to and is raised with the tape 34 and pivots about its hinge 32 to remove the projection 31 from the second slot 19. Further removal of the tape 34 lifts the remainder of the plastic seal 29 from the cover 14 and releases the open end 27 of the bag 12 which falls through the second slot 19 into the primary container 10. Continued removal of the tape 34 pulls up the closed end 26 of the bag 12 with the tape 34 and begins to pull the closed end 26 of the bag through the blades 21 and 22 of the squeegee. The tape 34 is then fully removed from the cover and pulled with the closed end 26 of the bag 12 away from the cover 14 to draw the entire bag 12 through the blades 21 and 22 of the squeegee to completely empty the contents of the bag into the primary container 10. A mixing blade may thereafter be inserted through the second slot 19 to mix the two fluids together or the cover 14 may be removed for mixing and dispensing of the contents.

I claim:

1. A container for two fluids to be mixed just prior to use comprising:

a rigid, fluid-tight, primary container having a cover and containing a first fluid, said cover being formed with two spaced parallel slots, a squeegee comprising a pair of parallel, closely spaced members fixedly positioned in the first of said slots in said cover parallel to said slots and projecting into said container, an elongate, flexible bag containing a second fluid, said bag passing through said squeegee into said primary container and out of the second of said slots in said cover with one end of said bag projecting from said primary container through said squeegee and the other end of said bag projecting from said primary container through said second slot, and a strip of tape covering the projecting ends of said bag and removably adhered to said cover around said bag ends, whereby said tape may be removed from said cover, the end of said bag projecting from said primary container through said second slot is permitted to slip through said second slot into said primary container and the end of said bag projecting from said primary container through said squeegee is pulled on to empty the contents of said bag into said primary container, the contents of said bag being substantially completely removed by said squeegee as the bag is pulled therethrough.

2. The container of claim 1 wherein said squeegee comprises a molded plastic insert having parallel, opposed, converging blades directed into said primary container.

3. The container of claim 2 wherein said plastic insert forms a part of said cover and includes portions surrounding both of said slots on the outer surface of said cover and portions directed into said primary container to define the walls of said second slot.

4. The container of claim 3 including a removable plastic seal for said second slot, said plastic seal having a generally planar portion covering said second slot between said tape and said cover and a projection from one face of said planar portion fitting into said second slot and with the end of said bag filling said second slot to seal it, said tape being adhered to said plastic seal and said plastic seal being formed for removal from said second slot with said tape as said tape is removed from said cover.

5. The container of claim 4 wherein the end of said bag extending out of said primary container through said squeegee extends between said cover and said planar portion of said plastic seal.

6. The container of claim 4 wherein said end of said bag projecting through said second slot is open and is folded back upon itself between said plastic seal and said cover to assure a fluid-tight seal.

7. The container of claim 6 wherein said open end of said bag extends back into said primary container through said second slot.

8. The container of claim 7 wherein said primary container is a cylindrical metal can.

9. The container of claim 8 wherein said bag is formed of a heat sealable plastic.

10. The container of claim 8 wherein said cover is removable.

* * * * *

UNITED STATES PATENT AND TRADEMARK OFFICE

CERTIFICATE OF CORRECTION

PATENT NO. : 4,130,198

DATED : December 19, 1978

INVENTOR(S) : Kenneth A. Aho

It is certified that error appears in the above-identified patent and that said Letters Patent are hereby corrected as shown below:

Column 2, line 50 "closed end 26" should be --open end 27--.

Column 2, line 52 "closed end 26 to" should be --open end 27 of--.

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*